United States Patent [19]

Heijnemans et al.

[11] 4,152,684

[45] May 1, 1979

[54] DEVICE FOR THE MAGNETIC DEFLECTION OF ELECTRON BEAMS

[75] Inventors: Werner A. L. Heijnemans; Johannes H. T. Van Roosmalen, both of Eindhoven, Netherlands

[73] Assignee: U.S. Philips Corporation, New York, N.Y.

[21] Appl. No.: 841,353

[22] Filed: Oct. 12, 1977

[30] Foreign Application Priority Data

Oct. 21, 1976 [NL] Netherlands ..... 7611641

[51] Int. Cl.[2] ..... H01F 7/00

[52] U.S. Cl. ..... 335/210; 335/213

[58] Field of Search ..... 335/210, 213

[56] References Cited

U.S. PATENT DOCUMENTS 2,433,682 12/1947 Bradley ..... 335/213 X 3,355,586 11/1967 Brechna et al. ..... 335/210 X 3,835,426 9/1974 Torsch ..... 335/213 X

*Primary Examiner*—George Harris

*Attorney, Agent, or Firm*—Henry I. Steckler; William J. Streeter; Thomas A. Briody

[57] ABSTRACT

A deflection device for the electron beam, in, for example, an image pick-up tube, comprising an annular yoke of a magnetic material, having at least two pairs of diametrically arranged, inwards directed cores which are enveloped by deflection coils. On the inner end of each core there is provided a poleshoe in the form of a ring segment, said poleshoes enclosing a deflection space. In order to ensure that the shape of the generated deflection fields can be accurately and reproducibly defined, each coil is situated, viewed from the deflection space, completely behind the associated poleshoe, the spaces between the poleshoes being bridged by intermediate pieces of a non-magnetic material.

6 Claims, 4 Drawing Figures

DEVICE FOR THE MAGNETIC DEFLECTION OF ELECTRON BEAMS

Figure 1:
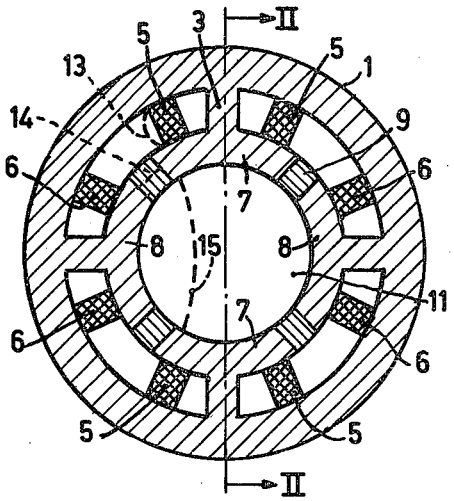

The invention relates to a device for the deflection of an electron beam in an electron tube, notably an image pick-up tube, comprising an annular yoke of magnetic material, having a number of radially inwards directed cores of magnetic material which are enveloped by deflection coils and which are provided on their inner end with poleshoes in the form of ring segments which enclose a deflection space. The term "magnetic material" is to be understood to mean herein a material having a magnetic permeability of 10 or more.

From Netherlands Patent Specification No. 54,218 a deflection device is known in which a yoke made of laminations with cores and pole shoes is used for one of the two deflection directions. It has been found in practice that the deflection fields generated by means of such a device do not have the very high accuracy and reproducibility required for some applications. An example of such an application is a colour television camera which comprises three pick-up tubes for the three basic colours (red, green, blue). The three images picked up by these tubes must ultimately be coincident, and it will be obvious that this is possible only if they are very accurately identical from a geometrical point of view. A condition to be satisfied in this respect consists in that the vertical as well as the horizontal deflection fields in the three tubes must be identical. The known winding techniques do not very well enable exactly identical deflection coils to be wound at a reasonable price, so that often groups of three reasonably identical pairs must be chosen from a lot of deflection coil pairs.

The invention has for its object to provide a device of the described kind in which the deflection fields ae not substantially influenced by small deviations in the deflection coils. To this end, the device in accordance with the invention is characterized in that at least one pair of diametrically oppositely arranged cores with deflection coils is provided for the horizontal deflection as well as for the vertical deflection, each deflection coil being situated, viewed from the deflection space, completely behind the associated poleshoe, each of the spaces between each two adjacently arranged poleshoes being bridged by an intermediate piece of non-magnetic material. The term "non-magnetic material" is to be understood to mean herein a material having a magnetic permeability of approximately 1.

Because the deflection coils for both deflection directions are situated completely behind the poleshoes, the shape of the deflection field is determined substantially completely by the shape of the poleshoes and the position of the poleshoes relative to each other. The position of the poleshoe is accurately defined by the intermediate pieces. Furthermore, notably the shape and the finish of the inner surface of the poleshoes, i.e. the surface visible from the deflection space, are important. The formation of poleshoes and the finishing of surfaces thereof can be realized much more accurately than the winding of coils, so that very exact deflection fields can be generated by means of the device in accordance with the invention. If desired, the accuracy can be further improved by grinding the surface of the assembly formed by poleshoes and intermediate pieces which faces the deflection space to be smooth.

The invention will be described in detail hereinafter with reference to the accompanying diagrammatic drawing.

Figure 2:
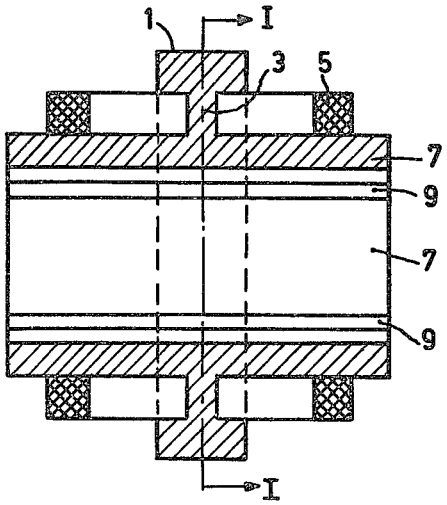
Figure 3:
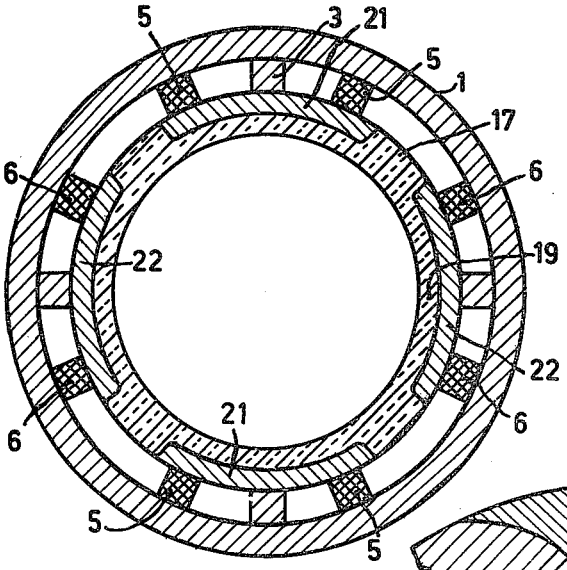
Figure 1A:
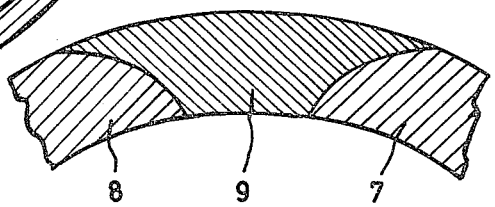

FIG. 1 is a cross-sectional view of a first embodiment of the device in accordance with the invention, FIG. 1A is a view at an increased scale of a detail of an alternative for the embodiment shown in FIG. 1, FIG. 2 is a longitudinal sectional view of the device shown in FIG. 1, and FIG. 3 is a cross-sectional view of a second embodiment of a device in accordance with the invention.

The device shown in the FIGS. 1 and 2 comprises an annular yoke 1 of magnetic material, having four radially inwards directed cores 3 of magnetic material which are enveloped by deflection coils 5 and 6 for horizontal deflection and vertical deflection, respectively. Each of the cores 3 is provided on its inner end with a poleshoe 7, 8 respectively, in the form of a ring segment. The space between each two poleshoes 7, 8 is bridged by an intermediate piece 9 of non-magnetic material. These intermediate pieces may be made of a synthetic material, but are preferably made of glass or a ceramic material such as aluminium oxide. The poleshoes 7, 8 are preferably made of ferrite and constitute, together with the intermediate pieces 9, a closed ring which encloses a deflection space 11. This ring is circular in the present embodiment. However, if desired it may have any other shape, for example, an elliptical or polygonal shape. Obviously, the same is applicable as regards the shape of the yoke 1. The deflection coils 5, 6 are arranged so that, viewed from the deflection space 11, they are completely hidden behind the poleshoes 7, 8. As a result, the shape of the deflection fields generated by the deflection coils 5, 6 in the deflection space 11 is determined by the shape of the poleshoes 7, 8 and not be details of the shape of the defelction coils. The shape of the poleshoes 7, 8 can be very accurately determined, notably if the surface of the annular assembly of poleshoes 7, 8 and intermediate pieces 9 which faces the deflection space 11 is ground to the correct dimensions. This offers the additional advantage that the diameter of the deflection space is accurately determined, so that the device properly fits around the glass envelope of an electron tube (not shown), for example, an image pick-up tube, in which the electron beam to be deflected is generated. An accurately defined diameter of the deflection space is also important when the device is arranged inside such an electron tube.

The assembly formed by the poleshoes 7, 8 and the intermediate pieces 9 can be made, for example, by using a basic material in the form of a solid rod of ferrite, the diameter of which at least equals the outer diameter of the ultimate assembly. Four grooves, regularly distributed over the circumference and extending parallel to the axis of the rod, are provided in this rod by grinding or sawing, the width of said grooves being equal to the desired space between the poleshoes 7, 8, the depth being slightly larger than the desired thickness of the poleshoes. Subsequently, these grooves are filled with a ceramic material. A hole is subsequently drilled into the centre of the rod in the axial direction, the wall of said hole being ground down until the diameter equals the desired diameter of the deflection space 11. Finally, the rod is cut into pieces of the desired length.

Subsequently, the cores 3 and the coils 5, 6 can be provided, for example, by gluing, after which the yoke 1 is secured. The cores 3 and the yoke 1 may consist of the same material as the poleshoes 7, 8 or of a different material. For example, the yoke may be made of laminated iron.

In order to ensure that the deflection field in the deflection space 11 is as strong as possible for a given current intensity in the coils 5, 6 (high sensitivity of the deflection coils), it must be ensured that the magnetic resistance in the air gaps between the ends of the poleshoes 7, 8 and the yoke 1 (for example, along the path 13 denoted by a broken line) is as high as possible. The magnetic flux is then forced to cross, via the deflection space 11, to the oppositely situated poleshoe (for example, along the path 15 denoted by a broken line). In order to achieve this object, the deflection coils 5, 6 extend in the tangential direction as far as the vicinity of the edge of the associated poleshoes 7, 8; obviously, the condition that the coils be hidden behind the poleshoes, viewed from the deflection space 11, must still be satisfied. Furthermore, the axial dimension of the yoke 1 is minimized. This is possible because the assembly of poleshoes 7, 8 and intermediate pieces 9 forms a rigid assembly, so that the yoke 1 does not have a mechanical function. As a result of these steps, the facing surfaces of the poleshoes 7, 8 on the one side, in as far as they are situated outside the deflection coils 5, 6 and the yoke 1 on the other side are as small as possible. The magnetic resistance along the path 13 is then as high as possible.

The foregoing is applicable notably to the coils 5 for the horizontal deflection, because the sensitivity of the coils 6 for the vertical deflection is generally primarily determined by losses in the coils themselves. Th coils 6 may, therefore, be situated at a distance from the edges of the poleshoes 8, if desired, which is larger than the distance between the coils 5 and the edge of the poleshoes 7.

The magnetic flux generated by the coil 5 cannot only be extracted from the deflection space 11 via the path 13, but also via a second path 14 and the poleshoes 8. The resistance along this path 14 can be increased, without modification of the surface of the poleshoes facing the deflection space 11, by widening the intermediate pieces 9 to be fan-shaped in the outward direction, as is shown at an increased scale in FIG. 1A. Because, obviously, the shape of the poleshoes 7 need not be identical to that of the poleshoes 8, if desired, the boundary between the poleshoe 7 and the intermediate piece 9 may also extend in the manner shown in FIG. 1A, and the boundary between the poleshoe 8 and the intermediate piece may extend in the manner shown in FIG. 1.

FIG. 3 shows a second embodiment of a device in accordance with the invention. The yoke 1, the cores 3 and the deflection coils 5, 6 are identical to the corresponding parts of the embodiment described with reference to the FIGS. 1 and 2. However, in this case the intermediate pieces 17 are formed by longitudinal ridges which are formed (for example by pressing or grinding) on the outer surface of a glass envelope 19 of an electron tube with which the device cooperates. The poleshoes 21, 22 are made of a mixture of a synthetic material and a granular ferromagnetic material (so termed plastoferrite) which is provided between the longitudinal ridge 17 on the envelope 19.

This embodiment is cheap and, because the outer surface of the glass envelope can be very accurately manufactured, its accuracy and reproducibility equal that of the first embodiment.

What is claimed is:

1. A device for the deflection of an electron beam in an electron tube comprising an annular yoke of magnetic material, said yoke having a number of radially inwards directed cores of magnetic material, deflection coils disposed on said cores, poleshoes provided on the inner end of said cores and having the form of ring segments which enclose a deflection space, at least one pair each of diametrically oppositely arranged cores with deflection coils being provided for horizontal deflection and for vertical deflection respectively, each deflection coil being situated when viewed from the deflection space completely behind the associated poleshoe, and a plurality of non-magnetic material pieces bridging each of the spaces between each two adjacently situated poleshoes respectively.

2. A device as claimed in claim 1, wherein the surface of the assembly of poleshoes and intermediate pieces which faces the deflection space is ground to the correct dimensions.

3. A device as claimed in claim 1, wherein at least the deflection coils for the horizontal defelection extend in the tangential direction as far as the vincinity of the edges of the associated poleshoes.

4. A device as claimed in claim 1, wherein the intermediate pieces comprise glass or a ceramic material.

5. A device as claimed in claim 1, wherein the poleshoes are provided on the outer surface of an envelope of an electron tube, each of the intermediate pieces comprising a longitudinal ridge formed integrally on said outer surface.

6. A device as claimed in claim 5, wherein the poleshoes comprise a mixture of a synthetic material and a granular ferromagnetic material.

* * * * *